United States Patent [19]

Ogata et al.

[11] Patent Number: 4,728,631

[45] Date of Patent: Mar. 1, 1988

[54] PRESSURE SENSITIVE RECORDING SHEET

[75] Inventors: Yasuhiro Ogata; Masakazu Maekawa, both of Shizuoka, Japan

[73] Assignee: Fuji Photo Film Co., Ltd., Kanagawa, Japan

[21] Appl. No.: 942,890

[22] Filed: Dec. 17, 1986

Related U.S. Application Data

[63] Continuation-in-part of Ser. No. 867,168, May 27, 1986, abandoned.

[30] Foreign Application Priority Data

May 24, 1985 [JP] Japan ..... 60-111935

[51] Int. Cl.[4] ..... B41M 5/16; B41M 5/22

[52] U.S. Cl. ..... 503/200; 427/150; 427/151; 428/211; 428/537.1; 428/537.5; 503/226

[58] Field of Search ..... 346/200, 226; 427/150–152; 428/211, 537.5, 537.1; 503/200, 226

[56] References Cited

U.S. PATENT DOCUMENTS 3,922,463 11/1975 Masaoka et al. ..... 346/200

FOREIGN PATENT DOCUMENTS

| | | | |
|---|---|---|---|
| 1197406 | 7/1970 | United Kingdom | 503/200 |
| 2092325 | 8/1982 | United Kingdom | 503/200 |
| 2112155 | 7/1983 | United Kingdom | 503/200 |
| 2112154 | 7/1983 | United Kingdom | 503/200 |
| 2111701 | 7/1983 | United Kingdom | 503/200 |

*Primary Examiner*—Bruce H. Hess

*Attorney, Agent, or Firm*—Sughrue, Mion, Zinn, Macpeak, and Seas

[57] ABSTRACT

A pressure sensitive recording sheet which uses specified raw paper as a paper support. The raw paper has a fiber length distribution such that the total amount of a percentage by weight of a 24 mesh residue and that of a 42 mesh residue is 65% or less by weight of the total residue as determined in accordance with the fiber classification method (JIS P-8207) and thereby both decreased process fog and increased color density of the developed images are attained.

5 Claims, No Drawings

PRESSURE SENSITIVE RECORDING SHEET

This Application is a Continuation-in-Part application of Ser. No. 867,168, filed May 27, 1986, now abandoned.

FIELD OF THE INVENTION

The present invention relates to a pressure sensitive recording sheet, and more particularly to a pressure sensitive recording sheet which utilizes a coloring reaction of an electron donating color former with an electron accepting color developer.

BACKGROUND OF THE INVENTION

Pressure sensitive recording sheets of the kind which utilize a reaction between an electron donating color former and an electron accepting color developer are widely known as no carbon required paper or pressure sensitive manifold paper, and specific examples thereof are described in U.S. Pat. Nos. 2,711,375, 2,712,507, 2,730,456, 2,730,457 and 3,617,334, Japanese Patent Publication Nos. 18317/63, 1178/72 and 20972/72, and so on.

Typical representative forms which have so far been employed in preparing and using pressure sensitive manifold paper are as follows. A suitable electron donating color former is dissolved in an appropriate solvent, microencapsulated and coated on a sheet to prepare the "upper sheet". Separately, a suitable electron accepting color developer is coated on a sheet to prepare the "lower sheet". Further, microcapsules of the electron donating color former are coated on one side of a sheet and the electron accepting color developer is coated on the other side of the sheet to prepare the "intermediate sheet". The upper sheet is brought into face-to-face contact with the lower sheet, and when one wants to obtain a number of copies one or more of the intermediate sheets are sandwiched between the upper sheet and the lower sheet. When pressure is applied to a set of the thus superposed sheets using a typewriter or writing means, the set functions as a pressure sensitive manifold paper to produce colored images. The colored images are produced through a process wherein microcapsules present in the pressed areas are destroyed and, thereby, the color formers enclosed on the inside of the microcapsules are transferred into the color developer layer together with an oil to undergo a reaction therein:

The pressure sensitive manifold papers of such a kind are widely used as various office forms, e.g., chits, computing machine paper and so on, and are of very useful.

The most important requirements for a pressure sensitive recording sheet are to have an excellent capacity for coloring by pressure applied thereto using a typewriter or a writing means, and to have little stain at the time of handling thereof, which includes the producing step, the processing step and so on, that is to say, to have little process fog.

Hitherto, in order to decrease fog arising from processing pressures, microcapsule protecting agents have been prevailingly employed. For example, cellulose fine powder (U.S. Pat. No. 2,711,375), starch granules (British Pat. No. 1,232,347, and Japanese Patent Publication Nos. 1178/72 and 33204/73), glass beads (U.S. Pat. No. 2,655,453), heat expansile high polymer particles (Japanese Patent Application (OPI) No. 32013/73 (the term "OPI" as used herein refers to a "published unexamined Japanese patent application")) and so on are known to be usable as the above described agent. However, the use of such microcapsule protecting agents, though enabling reduction of process fog, causes lowering of color density of the developed image upon copying. Accordingly, a measure of increasing the coverage of the microcapsules or the content of the color former has been employed industrially to make up for the lowering of the color density of the developed image. However, these measures suffer from disadvantages of entailing high cost and so on.

Further, a method of previously coating a microcapsule protecting agent of a water-soluble high polymer, such as starch or the like, and coating thereon microcapsules (Japanese Patent Application (OPI) Nos. 111288/80, 150210/79 and 87908/73, and Japanese Patent Publication Nos. 7398/80 and 41365/72) was proposed. However, the effects of such methods upon improvement in the color density are also less than anticipated in the present situation.

SUMMARY OF THE INVENTION

An object of the present invention is to provide a pressure sensitive recording sheet which does not generate much stain in the steps of production and processing thereof, that is to say, it does not generate much process fog, and is, in addition, excellent in color density of the image developed upon copying by typewriter or in human handwriting.

The above described object of the present invention is attained with a pressure sensitive recording sheet which uses raw paper having a fiber length distribution such that the total amount of a percentage by weight of a 24 mesh residue and that of a 42 mesh residue is 65% or less by weight of the total residue when determined by the fiber classification method (JIS P-8207 established Feb. 1, 1961).

DETAILED DESCRIPTION OF THE INVENTION

The determination of a fiber length distribution using a fiber classification method is carried out in the present invention according to JIS P-8207 to be used for method of screening test of paper pulp. More specifically, 10 g (as bone dry weight) of a sample is thoroughly disintegrated by a standard disintegrator, and submitted to a fiber classification analyzer (e.g., made by Toyo Seiki Seisakusho, Co., Ltd.) for 15 minutes. The classification analyzer has four screens, mesh sizes of which are 710 microns, 350 microns, 177 microns and 105 microns which are equivalent to 24 mesh, 42 mesh, 80 mesh and 150 mesh, respectively. The percentage of each fraction (wt %) is determined by weighing residues in four classification compartments and the portion having passed through the fourth screen (150 mesh).

Therefore, high percentages of the 24 mesh residue and the 42 mesh residue signify large proportions of long fibers.

The fiber length distribution that characterizes the present invention, which is determined by classification analysis, is a prescription regarding the fiber length distribution of paper making stock. In addition, the same prescription can be applied to the fiber length distribution of a rebreak product of a pressure sensitive recording sheet, provided that it is determined by the same method. In this case, coated compositions of the pressure sensitive recording sheet are removed using warm water and then the sheet is submitted to rebreak, followed by determination of the fiber length distribution in accordance with the method established by JIS P-8207. If the thus determined fiber length distribution shows that the total amount of a percentage by weight of a 24 mesh residue and that of a 42 mesh residue is 65% or less by weight of the total residue, the pressure sensitive recording sheet is within the scope of the present invention.

As a result of concentration of our energies on researches for producing a pressure sensitive recording sheet having both reduced process fog and excellent capacity for coloring, much to our surprise, it has been found out that not only marked reduction of process fog but also heightening of color density of the developed image are effected by using raw paper having such a fiber length distribution that the total amount of a percentage by weight of a 24 mesh residue and that of a 42 mesh residue is 65% or less by weight of the total residue.

The total amount of a percentage by weight of a 24 mesh residue and that of a 42 mesh residue is preferably 65% or less by weight of the total residue. More preferably, a percentage by weight of a 24 mesh residue is 10% or less by weight of the total residue.

Pulp which can be employed in the present invention includes various kinds of wood pulp (e.g., LBKP, NBKP, LBSP, NBSP, etc.). In addition, part or all of such wood pulp can be replaced by general vegetable fiber pulp like straw, esparto, etc. However, wood pulp is more desirable for achieving the object of the present invention. Specific examples of wood pulp include various kinds of hardwood pulp such a beech pulp, birch pulp, black alder pulp, oak pulp, Machilus Thunbergii pulp, pasania pulp, white birch pulp, white poplar pulp, poplar pulp, populus Maximowiczii pulp, eucalyptus pulp, mangrove pulp, lauan pulp, etc., and various kinds of softwood pulp such as Japanese red pine pulp, Japanese black pine pulp, abies pulp, Yeddo spruce pulp, fir pulp, hemlock spruce pulp, Japanese cedar pulp, Japanese cypress pulp, larch tree pulp, Japanese spruce pulp, hiba arborvitae pulp, Douglas fir pulp, hemlock pulp, white fir pulp, spruce pulp, cedar pulp, pine pulp, radiator pine pulp, etc. Good results can be obtained when hardwood pulp (L-wood pulp) and softwood pulp (N-wood pulp) are compounded in a ratio ranging from 50/50 to 100/0. The best compounding ratio of L-wood pulp to N-wood pulp (L-wood/N-wood ratio) is within the range of 80/20 to 100/0. This is because too large a fraction of N-wood pulp renders it difficult to reduce a long fiber portion.

In order to obtain the fiber length distribution specified by the present invention, it is to be desired that wood pulp should be submitted to a beating processing using a beater, refiner or a like machine. The beating processing is carried out to such an extent that the resulting wood pulp comes to have a Canadian standard freeness (JIS P-8121 established Dec. 25, 1953) ranging from 100 cc to 650 cc, more preferably from 150 cc to 550 cc, and most preferably from 200 cc to 450 cc. This is because too great a freeness makes it difficult to reduce a long fiber portion.

On the other hand, too small a freeness, though ensuring the reduction of a long fiber portion, causes troubles such as drop in rigidity of the resulting raw paper, insufficiency of dimensional stability of the resulting raw paper, and so on.

Raw paper to be used in accordance with the present invention is made up mainly of the pulp having the above described fiber length distribution, and further contains various additives. Specific examples of such additives include fillers such as clay, calcium carbonate, talc, etc.; internal sizing agents such as saponified rosin, rosin emulsions, alkenyl succinates, alkyl ketene dimers, alkenylsuccinic anhydrides, polymeric cation sizing agents, etc.; fixing agents such as sulfate alumina, etc.; paper strength intensifying agents such as polyacrylamide, starch, etc.; and dyes, pigments and fluorescent dyes which are used for controlling tone and whiteness. The raw paper may be surface sized with a natural substance or a derivative thereof, such as starch, denatured starch (e.g., oxidized starch, enzymatically degraded starch, α-starch, etc.), starch derivatives (e.g., hydroxyethylated starch, etherified starch, esterified starch, dialdehyde starch, etc.), cellulose derivatives (e.g., CMC, HEC, MC, etc.), glue, casein, gelatin, sodium alginate and so on; and a synthetic product such as latexes (e.g., SBR, NBR, Neoprene, etc.), polyvinyl alcohol, denatured PVA, styrene-maleic anhydride copolymers, polyacrylamide, styrene-acrylamide copolymers, polyurethane polymers, alkyl ketene dimers, fluorine resins, polyvinyl acetate, vinyl acetate-maleic anhydride copolymers, and so on. The surface sizing can be carried out using a size press or the like.

Further, pigments, dyes and/or cross-linking agents may optionally be used together with the above described surface sizing agents.

In any type of sheet, e.g., the "upper sheet" prepared by dissolving an appropriate electron donating color former in a proper solvent, microencapsulating the solution, and coating the resulting microcapsules on a paper support, the "lower sheet" prepared by coating an electron accepting color developer on a paper support, and the "intermediate sheet" prepared by coating the microcapsules on one side of a paper support and a color developer on the other side of the paper support, or the "self coloring sheet" prepared by coating the microcapsules and a color developer as a mixture or in a double layer form, the raw paper of the present invention ensures the reduction of process fog and the production of images excellent in color density when used as the paper support.

The term microcapsule as used in the present invention describes minute capsules of the kind which have, as contents, a basic colorless color former dissolved in an oily liquid, and, as a wall material for covering the contents, use a high molecular compound insoluble in both water and the oily liquid, and further have a mean particle diameter of 1 to 20 microns. Suitable examples of a wall material which can be employed therein include combinations of polycations with polyanions like a gelatin-gum arabic mixture, and combinations of ingredients which constitute a polycondensation system, such as a combination of polyisocyanate and polyamine, that of polyisocyanate and polyol, that of urea and formaldehyde, that of melamine and formaldehyde, and so on.

Such microcapsules can be produced using a process of separating a polymer phase from an aqueous solution (U.S. Pat. Nos. 2,800,457 and 2,800,458, Japanese Patent Publication Nos. 16166/72 and 32755/79, and so on), an external polymerization process (Japanese Patent Publication No. 12518/63, Japanese Patent Application (OPI) Nos. 42380/72, 8780/75, 9079/76, 66878/77, 84881/78, 84882/78 and 84883/78, Japanese Patent Application No. 126968/79 (corresponding to U.S. Pat. 4,409,156), and so on), an interfacial polymerization process (Japanese Patent publication Nos. 19574/63, 446/67, 771/67, 2882/67, 2883/67, 8693/67, 9654/67 and 11344/67, British Pat. Nos. 950,443 and 1,046,409, and so on), a process of supplying a wall material to the inside of drops of a core material and bringing about its polymerization at the surface of the drops (Japanese Patent Publication Nos. 9168/61 and 45133/74, and so on), or a fused dispersion cooling process (British Pat. Nos. 952,807 and 965,074, and so on).

The term color former as used in the present invention is intended to include compounds having such a property as to form a color by donating an electron or accepting a proton of an acid or the like. The present invention is not particularly restricted as to such compounds, and any compounds which are usually almost colorless, have a partial skeleton such as lactone, lactam, sultone, spiropyran, ester, amide or so on, and undergo ring opening or bond cleavage of the partial skeleton upon contact with a color developer can be employed. Specific examples of such a color former include Crystal Violet lactone, benzoyl leuco Methylene Blue, Malachite Green lactone, Rhodamine B lactam, 1,3,3-trimethyl-6'-ethyl-8'-butoxyindolinobenzospiropyran and so on.

These color formers are dissolved in solvents, and microencapsulated.

As for the solvents, natural or synthetic oils can be employed independently or in combination of two or more thereof. Specific examples of such oils include cotton seed oil, kerosene, paraffin, naphthene oil, alkylated biphenyls, alkylated terphenyls, chlorinated paraffins, alkylated naphthalenes, diarylethane, and so on.

Examples of a binder which can be effectively used in the present invention include latexes, such as styrene-butadiene rubber latex, styrene-butadiene-acrylonitrile latex, styrene-butadiene-maleic anhydride copolymer latex, acrylate latex, vinyl acetate latex, etc.; water-soluble natural high molecular compounds, such as proteins (e.g., gelatin, gum arabic, albumin, casein, etc.), celluloses (e.g., carboxymethyl cellulose, hydroxyethyl cellulose, etc.), saccharoses (e.g., agar, sodium alginate, starch, carboxymethyl starch, starch phosphate, etc.), and so on; water-soluble synthetic high molecular compounds, such as polyvinyl alcohol, polyvinyl pyrrolidone, polyacrylic acid, polyacrylamide, isobutylene-maleic anhydride copolymer, ethylene-maleic anhydride copolymer, polyvinylbenzenesulfonic acid, etc.; and the like.

A suitable protecting agent in the present invention is a granular substance which is present as a solid at ordinary temperature. Specific examples thereof include starch granules (British Pat. No. 1,232,347, etc.), fine powders of certain polymers (U.S. Pat. No. 3,625,736, etc.), microcapsulated particles containing no color formers (British Pat. No. 1,235,991, etc.), fine powders of celluloses (U.S. Pat. No. 2,711,375, etc.), fine particles of inorganic compounds such as talc, kaolin, bentonite, agalmatolite, zinc oxide, titanium oxide, alumina, etc., and so on. A desirable mean particle size of thes substances ranges from 3 to 50 microns, particularly from 5 to 40 microns, by volume average diameter. In addition, these particles can produce a greater effect when they are larger in size than microcapsules containing a color former.

The term color developer as used in the present invention is intended to include adsorptive or reactive compounds of the kind which can accept an electron or donate a proton, and develop a color upon contact with a color former as described above. Specific examples of such a color developers include clay minerals such as acid clay, bentonite, kaolin and the like, phenol-formaldehyde novolak resins, metal-processed novolak resins, zinc salts of aromatic carboxylic acids, and so on.

In a color developer solution, inorganic pigments such as talc, high quality clay, aluminum hydroxide, calcium carbonate, kaolin, calcined kaolin, acid clay, diatomaceous earth, zeolite, activated clay, zinc oxide, magnesium oxide, etc., and water-soluble high polymers as binder, such as carboxy-denatured styrene-butadiene latex, PVA, starch, HEC, etc., can be used.

A color developer and an inorganic pigment as described above are dispersed in fine particles having a size of 8 microns or less using a medium-utilizing dispersing machine, such as a sand mill, an attriter, a ball mill, a horizontal sand mill (Dyno mill) and so on.

Various additives to be employed in color developer solutions prepared in the above described manner or those to be employed in microcapsules of color formers, binders, antioxidants, smudge inhibitors, surface active agents, coating techniques and usages of these agents are well known in U.S. Pat. Nos. 2,711,375 and 3,625,736, British Pat. No. 1,232,347, Japanese Patent Application (OPI) Nos. 44012/75, 50112/75, 127718/75 and 30615/75, U.S. Pat. Nos. 3,836,383 and 3,846,331, and so on.

The thus prepared solution of a micro-encapsulated color former and that of a color developer can be coated using various conventional coating techniques, such as blade coating, air knife coating, bar coating, rod coating, roller coating, bill blade coating, curtain coating, fountain coating, gravure coating, spray coating, dip coating, extrusion coating and like ones. In some cases, it is also possible to carry out partial printing in accordance with an appropriate printing or coating process.

Further, auxiliary agents well known in the art of producing conventional pressure sensitive manifold papers, such as a dispersing agent, e.g., sodium alginate, sodium polyacrylate, etc., a viscosity modifying agent, a defoaming agent, and so on can optionally be employed.

The pressure sensitive recording sheet thus obtained in the present invention provides the developed images of high color density upon copying with a typewriter, a writing means, or so on, and has excellent coloring characteristics, especially reduced fog, under pressure applied in the course of processing (5 to 20 kg/m$^2$).

The present invention is illustrated in greater detail by reference to the following examples. However, the invention is not intended to be construed as being limited to these examples. Unless otherwise indicated, all parts and percents are by weight, and all coverages are on dry basis.

EXAMPLES

A microcapsule solution and a color developer solution to be employed in examples in accordance with the present invention and those for comparison were prepared in the following manner.

Preparation of Microcapsule Solution

100 Parts of diisopropylnaphthalene in which 2.5% of Crystal Violet lactone (CVL) and 2.0% of benzoyl leuco Methylene Blue (BLMB) were dissolved was emulsified by and dispersed into 100 parts of a 4.4% aqueous solution of partial sodium salt of polyvinylbenzenesulfonic acid (mean molecular weight: 500,000)

which was adjusted to pH 4. The thus obtained o/w type emulsion had a mean oil drop size of 4.5 microns.

Separately, 6 parts of melamine, 11 parts of a 37% formaldehyde solution and 83 parts of water were heated to 60° C. and stirred for 30 minutes to obtain a water solution of a mixture of melamine, formaldehyde and a melamine-formaldehyde initial condensate. The resulting mixture solution was admixed with the above described emulsion and thereto a 20% aqueous solution of acetic acid was added with stirring so as to adjust the pH of the resulting emulsion to 6.0. The temperature of the emulsion was raised to 65° C. and maintained at that temperature for 30 minutes to conclude the encapsulation.

To the resulting solution were added 200 parts of a 20% aqueous solution of etherified starch, 47 parts of starch granules (mean granule diameter 40 microns), and 10 parts of talc.

Thereto, 32 parts of a 2% aqueous solution of sodium dioctylsulfosuccinate was further added as surface active agent and water was furthermore added so as to adjust the concentration of the solids to 20%. Thus, the intended microcapsule solution was prepared.

Preparation of Color Developer Solution

25 Parts of activated clay, 75 parts of calcium carbonate, 10 parts of zinc oxide, 10 parts of zinc 3,5-di-α-methylbenzylsalicylate and 1 part of sodium hexametaphosphate were dispersed into 200 parts of water using a Kady mill, and further using a horizontal sand mill (Dyno mill, made by Shinmaru Enterprises Corporation) until they were converted into a fine dispersion in which particles having a volume average diameter of 3 microns or less were present.

The thus obtained dispersion was added with stirring to a mixed binder composed of 125 parts of an 8% aqueous solution of polyvinyl alcohol (PVA-117, trade name, products of Kuraray Co., Ltd.) and 10 parts (on solids basis) of carboxy-denatured SBR latex (SN-304, trade name, products of Sumitomo Naugatuc Co., Ltd.), and a concentration of the solids therein was adjusted to 20 wt % with water. Thus, the intended coating composition was prepared.

EXAMPLE 1

100 Parts of LBKP was employed as pulp, and beaten to 350 cc (CSF) using a double disk refiner. Thereto, rosin, aluminum sulfate and talc were added in proportions of 1%, 2%, and 10%, respectively, to the pulp. Thus, pulp stuff having a fiber length distribution as shown in Table 1 was obtained. The stuff was made into paper using a Fourdrinier paper machine, subjected to sizepress coating with an aqueous solution of oxidized starch so as to have a coverage of 1.0 g/m$^2$ (on a solids basis), and then subjected to calendering to prepare raw paper having a basis weight of 40 g/m$^2$ and a thickness of 52 microns. On the surface of the thus obtained raw paper was coated the above described microcapsule solution at a coverage of 4.0 g/M$^2$ (on a solids basis), and on the back thereof was coated the above described color developer solution at a coverage of 5.0 g/M$^2$ (on a solids basis). The coating was carried out using an air knife coater. Thus, a pressure sensitive recording sheet to be used as the "intermediate sheet" was obtained.

EXAMPLE 2

A pressure sensitive recording sheet to be used as the "intermediate sheet" was prepared in the same manner as in Example 1 except that a mixture of 85 parts of LBKP and 15 parts of NBKP was employed as pulp in place of 100 parts of LBKP, and the pulp was beaten using the double disk refiner until it came to have a beating degree of 250 cc (CSF) instead of 350 cc (CSF). The pulp stuff obtained therein had a fiber length distribution shown in Table 1.

EXAMPLE 3

A pressure sensitive recording sheet to be used as the "intermediate sheet" was prepared in the same manner as in Example 1 except that a mixture of 85 parts of LBKP and 15 parts of NBKP was employed as pulp in place of 100 parts of LBKP. The pulp stuff obtained therein had a fiber length distribution shown in Table 1.

COMPARATIVE EXAMPLE 1

A pressure sensitive recording sheet to be used as the "intermediate sheet" was prepared in the same manner as in Example 1 except that a mixture of 70 parts of LBKP and 30 parts of NBKP was employed as pulp, and beaten with the double disk refiner until its beating degree became 500 cc (CSF). The fiber length distribution of the beaten pulp is also shown in Table 1.

COMPARATIVE EXAMPLE 2

A pressure sensitive recording sheet to be used as the "intermediate sheet" was prepared in the same manner as in Example 1 except that a mixture of 50 parts of LBKP and 50 parts of NBKP was employed as pulp, and beaten with a refiner until its beating degree became 250 cc (CSF). The fiber length distribution of the thus beaten pulp is also shown in Table 1.

TABLE 1

| | Fiber Length Distribution (%) of Total Residue | | | | | | Properties of Pressure Sensitive Recording Sheet | |
|---|---|---|---|---|---|---|---|---|
| | 24 Mesh Residue | 42 Mesh Residue | 80 Mesh Residue | 150 Mesh Residue | 150 Mesh Passing Portion | Sum of 24 Mesh and 42 Mesh Residues | Process Fog Density | Typewriter Image Density |
| Example 1 | 0.5 (0) | 42.5 (42.3) | 20.8 (21.0) | 6.4 (6.2) | 30.3 (30.5) | 43.0 (42.3) | 0.10 | 0.43 |
| Example 2 | 7.1 (7.0) | 43.5 (43.7) | 23.1 (22.9) | 9.6 (10.0) | 16.7 (16.4) | 50.6 (50.7) | 0.13 | 0.40 |
| Example 3 | 9.6 (9.9) | 55.2 (54.8) | 21.6 (21.3) | 6.0 (6.5) | 7.6 (7.5) | 64.8 (64.7) | 0.13 | 0.40 |
| Comparative Example 1 | 20.4 (20.6) | 48.3 (48.1) | 15.6 (15.3) | 5.7 (6.0) | 10.0 (10.0) | 68.7 (68.7) | 0.23 | 0.35 |
| Comparative Example 2 | 25.3 (25.0) | 45.7 (45.9) | 16.0 (15.5) | 5.6 (5.9) | 7.4 (7.7) | 71.0 (70.9) | 0.26 | 0.33 |

As can be seen from the results set forth in Table 1, the pressure sensitive recording sheets of the present invention had excellent coloring characteristics, i.e., decreased density of process fog and high color density of the developed images.

Of the numerical values set forth in Table 1 for evaluating the fiber length distribution, those in parentheses represent fractions of the fibers having prescribed lengths which were determined with respect to the rebroken pressure sensitive recording sheet.

Process fog densities and typewriter image densities set forth in Table 1 were measured in the following manner.

Process Fog Density

Two of the intermediate sheets were superposed so that the microcapsule-coated side of one sheet and the color developer-coated side of the other sheet might be brought into face-to-face contact and thereto 10 $kg/cM^2$ of pressure was applied using an oil type pressure applying apparatus of variable pressure type to cause coloration. One day after, the color density was measured with a spectrophotometer.

Typewriter Image Density

Two of the intermediate sheets were superposed so that the microcapsule-coated side of one sheet and the color developer-coated side of the other sheet might be brought into a face-to-face contact and thereon the character "m" was densely written on a typewriter. One day after, the color density of the developed character "m" was measured with a spectrophotometer.

While the invention has been described in detail and with reference to specific embodiments thereof, it will be apparent to one skilled in the art that various changes and modifications can be made therein without departing from the spirit and scope thereof.

What is claimed is:

1. A pressure sensitive recording sheet which uses a coloring reaction of an electron donating color former with an electron accepting color developer and which comprises as a support raw paper having a fiber length distribution such that the total amount of a percentage by weight of a 24 mesh residue and that of a 42 mesh residue is 65% or less by weight of the total residue as determined in accordance with the fiber classification method established by JIS P-8207.

2. A pressure sensitive recording sheet of claim 1, wherein the fiber is from wood pulp or vegetable fiber pulp.

3. A pressure sensitive recording sheet of claim 2, wherein said pulp is wood pulp.

4. A pressure sensitive recording sheet of claim 3, wherein said wood pulp is L-wood pulp and N-wood pulp in a ratio within the range of 80/20 to 100/0.

5. A pressure sensitive recording sheet of claim 1, wherein the percentage by weight of a 24-mesh residue is 10% or less by weight of the total residue.

* * * * *